United States Patent [19]

Montabert

[11] 4,109,734

[45] Aug. 29, 1978

[54] PERCUSSION MACHINE

[76] Inventor: Roger Montabert, 19 avenue des Colonnes, Bron (Rhone), France

[21] Appl. No.: 738,455

[22] Filed: Nov. 3, 1976

[30] Foreign Application Priority Data

Nov. 4, 1975 [FR] France ..... 75 34373

[51] Int. Cl.[2] ..... B25D 9/00

[52] U.S. Cl. ..... 173/114; 173/131; 173/139

[58] Field of Search ..... 173/102, 114, 131, 132, 173/133, 134, 137, 139; 92/85 R, 85 B

[56] References Cited

U.S. PATENT DOCUMENTS

| | | | |
|---|---|---|---|
| 3,168,324 | 2/1965 | Kennell | 173/139 |
| 3,223,182 | 12/1965 | Mikiya | 173/114 |
| 3,344,868 | 10/1967 | Mikiya et al. | 173/114 |
| 3,827,507 | 8/1974 | Lance | 173/134 |
| 3,896,889 | 7/1975 | Bouyoucos | 173/120 |

*Primary Examiner*—Robert A. Hafer
*Attorney, Agent, or Firm*—Karl F. Ross

[57] ABSTRACT

To facilitate the return of a percussion tool by the action of the striking mass, namely, a double-acting piston, without damage to the machine body, the tool is held by a casing attached to the body and the tool. The latter piston defines a chamber with a confronting face of the casing, the chamber being supplied with a liquid under pressure through a check valve. The chamber is connected to a reservoir by a pressure-relief valve.

8 Claims, 1 Drawing Figure

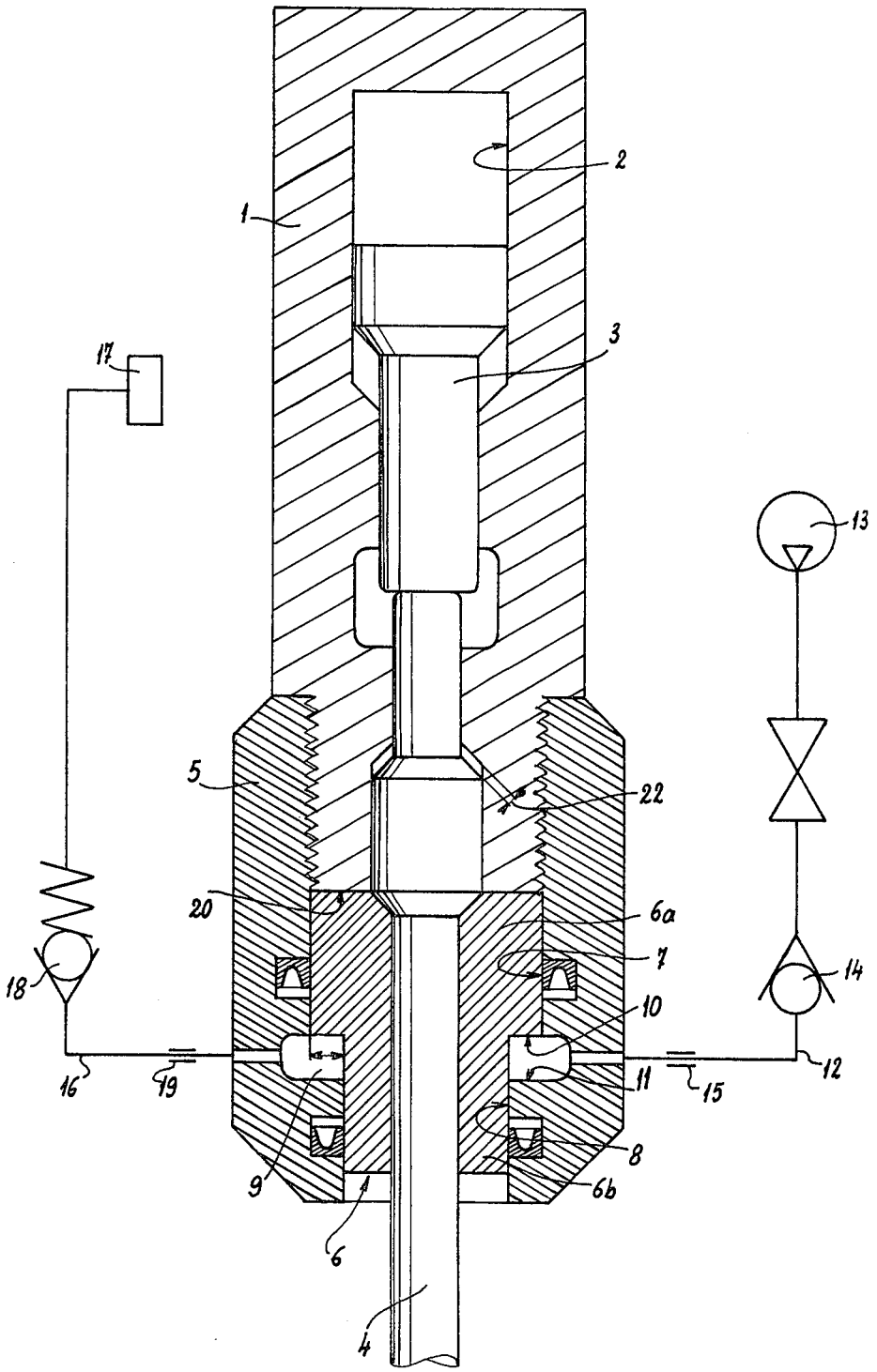
1
2
3
4
5
6
6a
6b
7
8
9
10
11
12
13
14
15
16
17
18
19
20
22

PERCUSSION MACHINE

FIELD OF THE INVENTION

The present invention relates to an impact machine.

BACKGROUND OF THE INVENTION

Machines utilizing impact as a means for effecting a working operation applying a large amount of substantially instantaneous (high energy rate) energy comprise a striking mass constituted usually by a double-acting piston capable of movement in either direction and the tool which transmits the kinetic energy of the striking mass at the moment of impact to the point where this energy is utilized by conversion to a shock wave.

In normal use the extremity of the tool, which is located outside the machine, is maintained in contact with the material to which the impact is delivered in such manner that the drills of energy is accomplished under the best working conditions. Such impact machines include fluidpowered breakers, crills, chisels, hammers, and like percussion devices which may be hand-held or support or vehicle mounted.

In carrying out impact work it has been found that the return movement of the tool presents certain difficulties. This is particularly so in the drilling of a bore of a considerable depth or in the use of a demolition tool in material of high impact strength. It is then advantageous to be able to employ the trains of shock waves previously used to break the material to subject the tool to an extracting force which facilitates the withdrawal of the tool.

Unfortunately, in conventional machines, the first component affected by the passage of the shock wave is the part of the machine effecting the return of the tool and if particular precautions are not taken this machine part is destroyed and often with it other parts of the machine. Thus in conventional machines a clearance is provided to separate the tool sufficiently from the striking mass when the latter effects a return movement. During the supplementary stroke of the striking piston, an absorption device or so called dash pot which absorbs the kinetic energy of the piston, comes into play.

OBJECT OF THE INVENTION

The present invention has as its object the provision of an arrangement integral with the percussion machine which permits the passage of a train of shock waves through the tool during the return movement without risk of destuction by fatigue of the pieces of the machine effecting this movement.

SUMMARY OF THE INVENTION

For this purpose according to the present invention there is provided a percussion machine of the type which comprises a striking mass constituted by a double-acting piston capable of movement in both directions and acting on a tool serving to transmit the kinetic energy of the striking mass at the moment of impact to a point where this energy is utilized as an impact.

According to the invention, the tool is retained in the machine by a further piston which is mounted for sliding movement in a solid casing of the body of the machine. The face of the further piston disposed at the side opposite to that of the striking mass (i.e. the face turned away from this mass) together with the extremity of the casing in which it is situated delimits an annular chamber connected to a source of incompressible fluid under pressure by a circuit in which is located a non-return (check) valve and also connected to a reservoir by a circuit in which is provided a pressure relief valve.

Advantageously the tool body comprises a casing enclosing the further piston. This casing comprises two coaxial passages of which the smaller diameter one is disposed at the free end of the casing (i.e. the mouth thereof) and the piston through which the tool passes comprises two parts of respective diameters corresponding to those of the two passages. The chamber containing the pressure fluid is delimited by the respective face of the piston and the shoulder which is provided at the junction of the different diameter zones.

When the striking mass is actuated, each impact induces in the tool a shock wave which is converted into a compression force and the displacement due to the deformation of the material under the effect of this force. This displacement brings about a displacement of the same order in the piston.

This displacement of the piston causes part of the incompressible fluid filling the chamber to escape towards the reservoir through the pressure relief valve. This phenomenon has the effect of laminating the fluid and of transforming into heat an important part of the energy transmitted in the form of shock waves to the tool. After escape of a certain quantity of fluid the annular chamber is again filled by the arrival of incompressible fluid under high pressure which is not laminated and not heated during the interval between two impacts.

This arrangement has the effect of reducing the force applied to the casing to a value sufficiently small to be tolerated indefinitely by the machine.

BRIEF DESCRIPTION OF THE DRAWING

The invention will be better understood from the following description referring to the sole FIGURE of the annexed schematic drawing which shows by way of example a longitudinal sectional view of a percussion machine according to the invention where the striking mass is applied to the head of the tool.

SPECIFIC DESCRIPTION

The machine shown in the drawing comprises, in the interior of a body 1, a cylinder 2 within which is an impact piston 3 which can be displaced in opposite directions by fluid pressure means as described in my U.S. Pat. No. 3,822,752 but not shown.

A tool 4 is retained in a casing 5 forming an extension of the machine by a stepped piston 6. This piston 6 can slide in co-axially arranged passages 7 and 8 in the casing 5. It should be noted that the passage 8 at the free end or mouth of the casing 5 is of smaller cross-section than the passage 7. The piston 6 thus comprises two parts, that is to say a part **6*a* of a cross-section corresponding to that of the passage 7 and a part 6*b* of a cross-section corresponding to that of the passage 8**.

The confronting faces 10 and 11 of the piston 6 and the case 5 respectively serve to define the zones of change in cross-section of the piston and casing and together delimit an annular chamber 9 which is filled with liquid under pressure. This annular chamber 9 is connected by means of a circuit 12 to a source 13 (e.g. a pump) of pressure fluid, a nonreturn (check) valve 14 and a limited delivery orifice (throttle) **15*b* also provided in the circuit 12. The annular chamber 9 is connected also to a sump 17 (e.g. the reservoir supplying the pump 13) by a circuit 16, a pressure-relief valve 18** and a limited-flow orifice (throttle) 19 being provided in the circuit 16.

The operation of the machine during the return stroke of the tool is as follows:

The circuit 12 is fed with high pressure fluid until the chamber 9 is filled. The hydrostatic force which is thereby applied to the annular face 10 of the piston 6 propels this face upwardly towards the face 20 of the body of the machine against which it comes into contact.

The clearance 22 between the tool 4 and the body 1 is thus returned to a predetermined small value. The impact piston 3 which is then actuated induces in the tool 4 a shock wave, which takes the form of a compressive force, and a displacement due to the deformation of the material under this force.

This displacement causes a displacement of the same order of the piston 6 having the same amplitude but greater speed. The portion of the energy absorbed by the piston 6 in the displacement is transformed to pressure in the chamber 9 then dissipated partly across the orifice 19 and the valve 18 and returned in part by the elasticity of the fluid to the tool 4. Since a certain quantity of fluid has been discharged by the orifice 19 at the moment of impact an equal quantity of fluid is admitted into the chamber 9 by means of the circuit 12 during the interval between two impacts.

During the active working sequence of the tool there is imparted to the body 1 a pressure in the direction of the tool of such a kind that an enlarged end portion of the tool contacts with the body 1, that is the clearance 22 is reduced to zero, and no longer contacts the piston 6 which abuts the face 20. During this work sequence the assembly of piston 6 hydraulic circuit 9, 12, 16 plays no part.

I claim:

1. A percussion machine comprising:

a solid housing body forming a cylinder;

a double-acting piston reciprocatable in said cylinder and forming a striking mass;

a tool aligned with and receiving impact from said striking mass;

means for retaining said tool on said body, said retaining means including:

a casing fixed to said body and forming a further cylinder;

a further piston surrounding said tool and slidable with said tool and relative thereto in said casing; and an annular chamber defined within said casing between a face of said further piston turned away from said striking mass and a confronting face of said casing;

a source of an incompressible fluid under pressure connected to said chamber;

a check valve between said source and said chamber;

a reservoir connected to said chamber; and a pressure-relief valve connected between said chamber and said reservoir, said further cylinder being coaxial with said tool and formed with a portion of large cross-section on a side of said casing turned toward said piston and a portion of small cross-section on a side of said casing turned away from said piston, said face of said casing being disposed between said portions, said further piston being stepped and having large and small cross-section portions respectively slidable in corresponding portions of said further cylinder and separated by said face of said further piston.

2. The percussion machine defined in claim 1, further comprising a throttle between said source and said chamber.

3. The percussion machine defined in claim 2 wherein said throttle is connected between said check valve and said chamber.

4. The percussion machine defined in claim 1, further comprising a throttle between said reservoir and said chamber.

5. The percussion machine defined in claim 4 wherein said throttle is connected between said chamber and said pressure-relief valve.

6. The percussion machine defined in claim 1 wherein a throttle is connected between said source and said chamber.

7. The percussion machine defined in claim 6 wherein a throttle is connected between said reservoir and said chamber.

8. The percussion machine defined in claim 1 wherein a throttle is connected between said reservoir and said chamber.

* * * * *